United States Patent [19]

Kawasaki

[11] Patent Number: 4,928,609

[45] Date of Patent: May 29, 1990

[54] AUTOMATIC SEWING APPARATUS

[75] Inventor: Kiyoshi Kawasaki, Akishima, Japan

[73] Assignee: Tachi-S Company, Ltd., Tokyo, Japan

[21] Appl. No.: 325,410

[22] Filed: Mar. 20, 1989

[30] Foreign Application Priority Data

Aug. 9, 1988 [JP] Japan ..... 63-198698

[51] Int. Cl.[5] ..... D05B 21/00

[52] U.S. Cl. ..... 112/121.12; 112/121.26; 112/148; 112/121.23; 112/308

[58] Field of Search ..... 112/121.12, 121.15, 112/121.26, 148, 153, 306, 308, 311, 309, 102, 103, 2, 121.23

[56] References Cited

U.S. PATENT DOCUMENTS 3,653,347 4/1972 Bianchi ..... 112/121.12
4,008,672 2/1977 Cianciotti ..... 112/121.12
4,359,009 11/1982 Bennison ..... 112/102 X
4,394,840 7/1983 Diekmann et al. ..... 112/121.15

*Primary Examiner*—Peter Nerbun
*Attorney, Agent, or Firm*—Browdy and Neimark

[57] ABSTRACT

An automatic sewing apparatus which permits sewing together a curved edge of a first blank material and an edge of a second blank material, precisely and automatically. The construction of the sewing apparatus is such that on the table of sewing machine, a lower guide plate for securing the second blank material is movably mounted, and above the lower guide plate, provided is an upper guide plate having a movable guide piece slidable along a guide groove formed in the upper guide plate, the movable guide piece being for securing the first blank material. The lower guide plate is movable along a guide groove formed on the table. The two guide grooves are respectively formed in a shape conforming to a track required for orienting the relevant edge in a direction identical to the sewing path of the sewing machine.

13 Claims, 7 Drawing Sheets

AUTOMATIC SEWING APPARATUS

BACKGROUND OF THE INVENTION

1. Field of the Invention

The present invention relates to an automatic sewing apparatus adapted for use in the sewing of a trim cover assembly of automotive seat, and is in particular directed to the one which permits sewing together of two different blank cover materials each having different shapes of edges (for example, curved, sinuously-cut or rectilinear edges); namely, sewing the juxtaposed different edges of those two cover materials into a trim cover assembly of automotive seat.

2. Description of the Prior Art

Producing a trim cover assembly for use on an automotive seat, as well known, involves the steps where operators cut out various shapes of blank cover materials to provide a number of seat cover constituent parts; for instance, a central seating part, a peripheral bolster part and a side wall part, which form the trim cover assembly, and then sew those parts together into a three-dimensional shape of trim cover assembly, which is subsequently to be affixed over a cushion member for the seat assembling purpose.

By and large, those three separate cover elements have their own edges whose shapes are different from one another. In some cases, the edge of the central seating part is formed rectilinearly while that of the adjoining peripheral bolster part is formed in a curved or uneven manner, and in other cases, both central seating and peripheral bolster parts are formed in an uneven manner differently from each other. Consequently, in assembling the trim cover assembly, the different edges of the cover elements are juxtaposed together precisely and put in a state for sewing by a sewing machine.

Such step of setting the cover elements for sewing and subsequent sewing operation has been executed manually by operators, such that the operators feed the unevenly shaped edge of the peripheral bolster part along the differently shaped edge of the central seating part, towards the sewing machine, in order to sew them together.

At the side of the operators, therefore, an extreme attention and high degree of skill are required for moving and feeding the cover elements for a precise sewing thereof, and no effective automatic system exists in that respect. As a result, sewing the uneven ledges of seat cover elements has remained a difficult manual technique that stalemates the improvement in rapidity of sewing as well as innovation in this particular field.

SUMMARY OF THE INVENTION

It is a purpose of the present invention to provide an automatic sewing apparatus which permits sewing together of two differently curved edges of blank materials or sewing together rectilinear and curved edges thereof, precisely and automatically.

In accomplishment of such purposes, the present invention comprises a lower guide plate slidably mounted on a table of a sewing machine and an upper guide plate provided above the lower guide plate. The lower guide plate is so constructed that its upper surface is adapted for securing a first blank material thereon, with one edge of the first blank material being projected from the lower guide plate, and a guide roller is rotatably provided on the reverse side of the lower guide plate and slidingly fitted in a first guide groove formed on the table of the sewing machine. On the other hand, the upper guide plate is fixed stationary on the table, extending above the lower guide plate, and adapted for securing thereon a second blank material having a edge different in shape from that of the first blank material, with such a structure that on the upper surface of the upper guide plate, there is formed a second guide groove, and a movable guide piece, with a guide roller rotatably provided thereunder and slidably fitted in the second guide groove, is mounted movably on the upper guide plate.

The first guide groove is formed in conformity with a track which ought to be shown by the guide roller of the lower guide plate in order to feed the edge of the first blank material in a direction parallel with a sewing path wherein that edge is sewn by the sewing machine. The second guide groove is likewise defined in a shape conforming to a track which ought to be shown by the guide roller of the movable guide piece in order to feed the edge of the second blank material in a direction parallel with the sewing path. In the case where one of those two edges is shaped rectilinearly, the relevant guide groove is formed rectilinearly in parallel with the sewing path, and in the case that the other of the two edges is shaped in an irregularly curved manner, the relevant guide groove is formed in a proper shape to feed the corresponding edge tangentially in parallel with the sewing path.

Accordingly, the two differently shaped edges are fed by the lower and upper guide plate and precisely juxtaposed and sewn with each other by the sewing machine, in an unattended, automatical manner.

In one aspect, the upper guide plate is inclined upwardly from the lower guide plate, representing an inclined guide surface. This is advantageously effective in making easy and smooth the sliding movement of the movable guide piece along the second guide groove, which results in a more smoothly guiding of the second blank material for sewing.

DETAILED EMBODIMENTS OF PREFERRED EMBODIMENTS OF THE INVENTION

Referring firstly to FIGS. 1(A), 1(B), 1(C), 1(D) and 1(E), there is shown a trim cover assembly (A) which is assembled by an automatic sewing apparatus in accordance with the present invention, and also shown are the base cover blank materials forming the trim cover assembly (A).

Figure 1A:
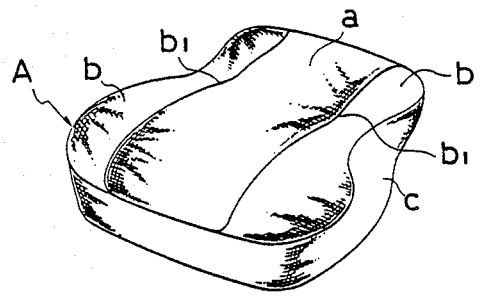
FIG. 1(A) is a perspective view of a seat cushion of an automotive seat, whose trim cover assembly is formed by an automatic sewing apparatus of the present invention.
Figure 1B:
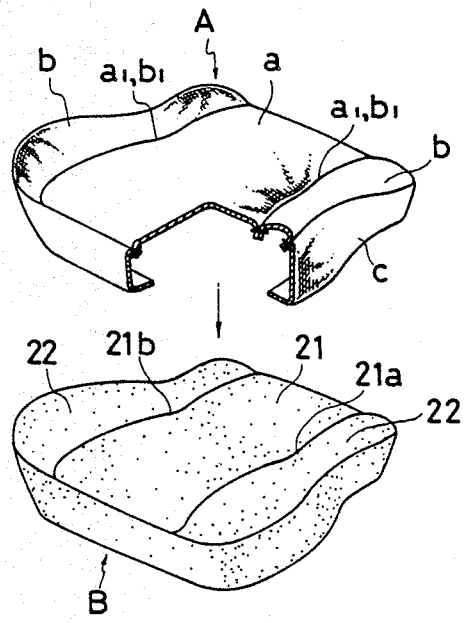
FIG. 1(B) is a partially broken, exploded perspective view of the same seat cushion as in the FIG. 1(A)

FIGS. 1(A) and 1(B) show a seat cushion of the automotive seat, by way of an example, as one of works to be affixed with a trim cover assembly produced by the present invention. The seat cushion comprises the trim cover assembly (A) and a cushion member (B) covered therewith. As shown, the trim cover assembly (A) is composed of a central seating part (a), a peripheral bolster part (b) and a lateral wall part (c). The cushion member (B) is made of a foam material (urethane foam, for example) and has an uneven upper seating surface: Its central seating part (21) corresponding to the one (a) of the trim cover assembly (A) is formed generally flat, while on the other hand its peripheral bolster part (b) corresponding to the one (b) of the same assembly (A) is raised or protrudent.

Figure 1C:
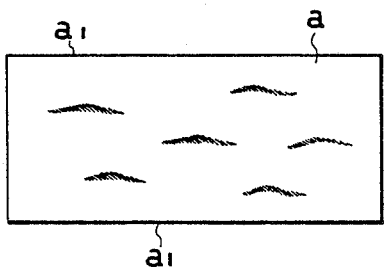
FIG. 1(C) is a plan view of a central seating part of the trim cover assembly.
Figure 1D:
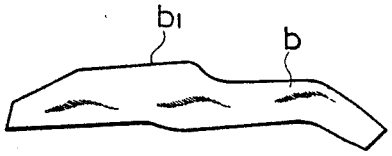
FIG. 1(D) is a plan view of a peripheral bolster part of the trim cover assembly.

In this particular unevenly bulging seat cushion, it is the case that a curved or sinuous line is defined in the boundaries (21*a*)(21*b*) between the central seating part and peripheral bolster parts therein, for which reason, the central seating part (a) and peripheral bolster part (b) of the trim cover assembly (A) are formed, as seen in FIGS. 1(C) and 1(D), such that the former is of a rectangular shape, having a pair of rectilinear edges (a1)(a1) defined at its both sides, and the latter is of an irregularly deformed configuration, having an irregularly curved or sinuously shaped edge (b1) at its one side, whereby those two parts (a)(b), when sewn together at their respective edges (a1)(b1), form a proper cover element which will be neatly stretched over and along the uneven surface of the cushion member (B).

Figure 1E:
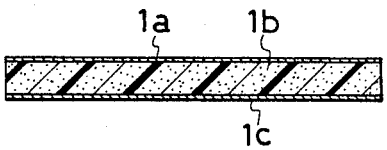
FIG. 1(E) is a sectional view of the trim cover assembly.

As in FIG. 1(E), each of the above-stated three cover elements (a), (b) and (c) is formed by a three-layer lamination including a top surface layer (1*a*) made of a cloth, leather, synthetic resin film, a wadding layer (1*b*) of a slab urethane foam having about 10 mm thickness, and a wadding back layer (1*c*) made of a non-woven fabric.

Figure 2:
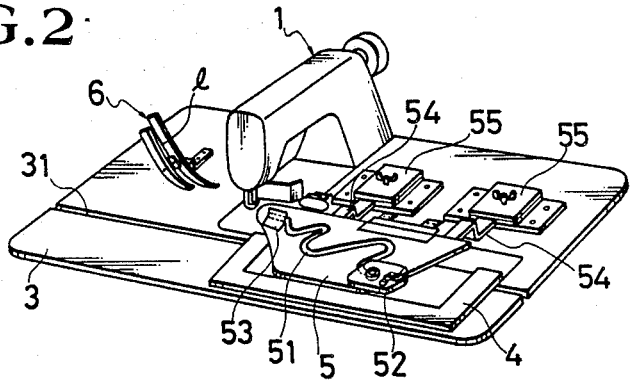
FIG. 2 is a perspective view of an automatic sewing apparatus in accordance with the present invention.

Reference is now made to FIG. 2, wherein illustrated is an automatic sewing apparatus in accordance with the present invention, which permits sewing together the above-mentioned central seating part (a) and peripheral bolster part (b) at their respective edges (a1)(b1), automatically.

Designation (1) denotes an electric sewing machine which has a table (3) provided thereon, the table (3) being formed with a rectilinear groove (31). As shown, the groove (31) is disposed forwardly of the sewing machine (1), extending in the longitudinal direction of the table (3).

Figure 5:
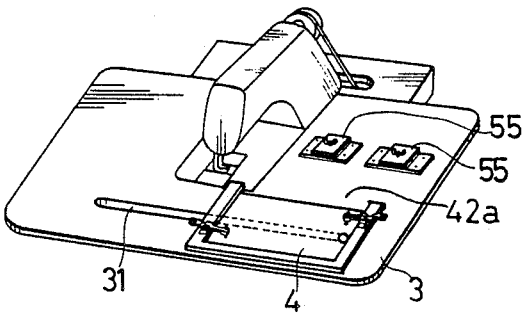
FIG. 5 is a perspective view of the sewing apparatus, which is intended to clearly show the mounting state of the lower guide plate.

A lower guide plate (4) is slidably provided upon the table (3), and adapted for receiving the central seating part (a) associated with the trim cover assembly (A). Specifically, by referring to FIGS. 3, 4, 5 and 6, the lower guide plate (4) is so formed that a recessed area (44) is defined therein with a '⊔'-shaped rim (42) raised at the peripheral sides of the lower guide plate (4) and an opened side (42*a*) defined at one side (as seen in FIG. 5), thereby allowing the central seating (a) to be placed on the recessed area (44), with its edge (a1) being projected, preferably at 20 mm, from the opened side (42*a*) to create a proper sewing margin (m) in relation to the needle (2) of the sewing machine (1) (See FIG. 5). This lower guide plate (4) has a pair of guide rollers (41)(41) provided at its reverse side in a free-to-rotate manner, the guide rollers (41)(41) being spaced apart from and aligned with each other on the same line, and further rotatably fitted in the foregoing rectilinear groove (31). Also, a pair of clamps (43)(43) are equipped on the upper surface of the lower guide plate (4) such that they are disposed at the respective opposed lateral rim sections of the rim (42) in an offset relation. By means of the clamps (43)(43), the central seating part (a) is secured on the lower guide plate (4).

Accordingly, the lower guide plate (4) is slidable along the rectilinear groove (31), which allows linear movement of the central seating part (a) thereon towards the sewing machine (1). Thus, due to this linear movability, the edge (a1) of the central seating part (a) is to be transferred in a straight-line direction to the sewing needle (2) in parallel with a sewing direction wherein the sewing margin (m) adjacent the edge (a1) is fed and sewn by the sewing machine (1).

Figure 6:
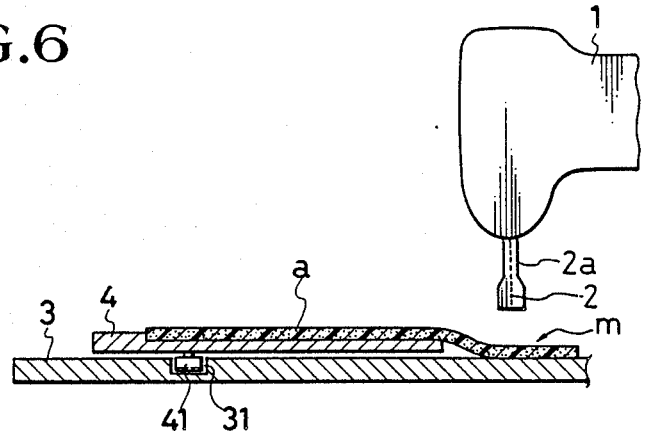
FIG. 6 is a sectional view showing the state wherein the central seating part is mounted on the lower guide plate.

FIG. 6 shows the state wherein the central seating part (a) secured on the lower guide plate (4) is in the progress of being sewn by the sewing machine (1). It is seen that the sewing margin (m) adjacent the edge (a1) of the central seating part (a) is pressed and fed by the pressing retainer member (2*a*) of the sewing machine (1), and sewn with the edge (b1) of the peripheral bolster part (b) simultaneously as will be explained later. In this connection, preferably the sewing needle is set against the margin (m) at point of 10 mm inwardly from the edge (a1).

Referring again to FIG. 2, above the foregoing lower guide plate (4), there is provided an upper stationary guide plate (5) made of a plastic material having a smooth plane surface, which is supported by a pair of support arms (54)(54) firmly secured on the respective securing (55)(55) fast on the table (3). As best understandable from FIG. 12, the support arms (54)(54) each comprises a horizontal base section (54*a*) and an upwardly inclined support section (54*b*), and it is seen that the upper stationary guide plate (4) is fixedly supported on the upwardly inclined support section (54*b*) at a given inclination angle relative to the horizontal base section (54*a*), representing an inclined guide surface in relation to the lower guide plate (54) and table (3). It is desirable that the inclination angle of the upper guide plate (5) should be set within the range of 30 to 45 degrees relative to the horizontal base sections (54*b*) of the support arms (54)(54), with a view to making easy and smooth the sliding movement of a movable guide piece (52) that will be stated below.

Figure 7:
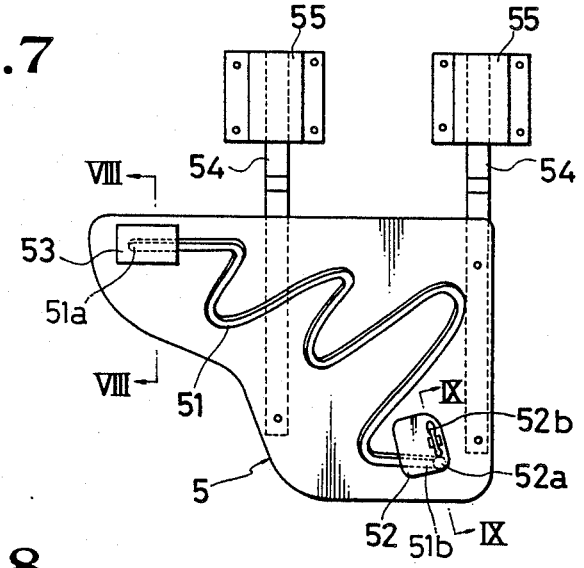
FIG. 7 is a plan view of an upper guide plate.
Figure 8:
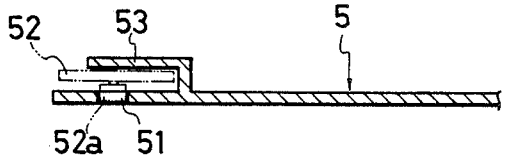
FIG. 8 is a sectional view taken along the line VIII—VIII in the FIG. 7.
Figure 9:
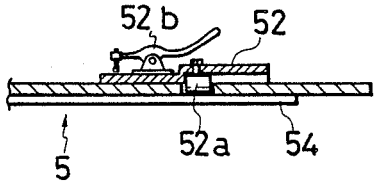
FIG. 9 is a sectional view taken along the line IX—IX in the FIG. 7.

As shown in FIG. 7, on the upper stationary guide plate (5), formed is a meandered or sinuous guide groove (51) and a movable guide piece (52) is slidably fitted in the meandered guide groove (51) in such a manner as to be movable therealong from its second extremity (51*b*) to its first one (51*a*), or vice versa,. As shown, the first extremity (51*a*) of the meandered guide groove (51) defines a sewing starting point adjacent the needle (2) of the sewing machine while the second extremity (51*b*) thereof defines an initial point of the movable guide piece (52) at the corner opposed diagonally to that where the first extremity (52*b*) is located.

The movable guide piece (52) has a roller which is rotatably provided thereunder and slidably fitted in the meandered guide groove (51). On the upper surface of the movable guide piece (52), equipped is a clamp (52*a*) for securing the rearward end of the aforementioned peripheral bolster part (b).

Figure 3:
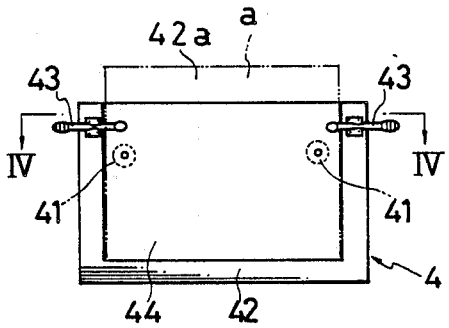
FIG. 3 is a plan view of a lower guide plate of the automatic sewing apparatus.
Figure 4:
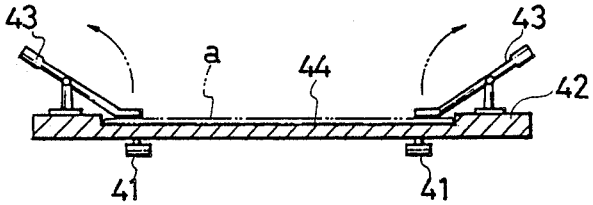
FIG. 4 is a sectional view taken along the line IV—IV in the FIG. 3.

A support guide member (53) is provided at the first extremity (51*a*) of the meandered guide groove (51). The support guide member (53), as best shown in FIG. 3, is integrally formed on the upper stationary guide plate (5), raising therefrom to define a "⊓" shape in section for guiding therein the peripheral bolster part (b) and the movable guide piece (52). By the support member (53), the movable guide piece (52), when being moved therein, is prevented from being removed from the guide groove (51), as will become apparent later.

It should be noted that at an initial state, the movable guide piece (52) is positioned at the second extremity (51*b*) of the meandered guide groove (51) in an opposed relation with the support guide member (53).

Figure 10:
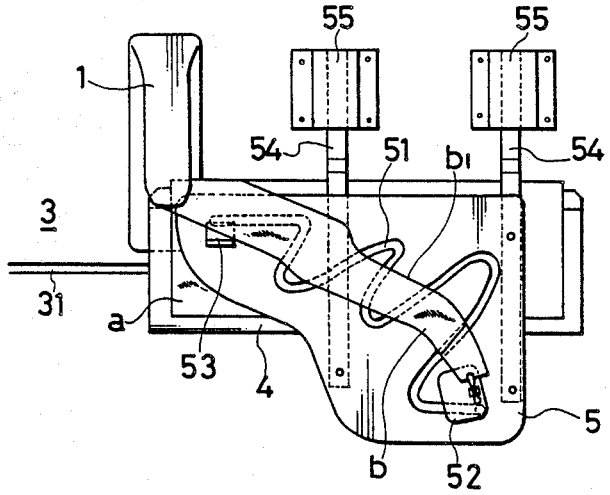
FIG. 10 is a plan view of the sewing apparatus, which shows an initial state wherein both central seating and peripheral bolster parts are secured on the lower and upper guide plates, respectively.

Upon this upper stationary guide plate (5), is secured the peripheral bolster part (b). As seen in FIG. 10, the peripheral bolster part (b) is secured at two points; namely, the forward end portion thereof is secured at the support guide member (53) whereas the rearward end portion thereof is secured at the movable guide member (52), with the peripheral bolster part (b) per se laying generally on a diagonal line in the upper stationary guide plate (5).

The meandered guide groove (51) illustrated is formed in a shape conforming to a track which ought to be shown by the guide roller (52*a*) in order for the associated movable guide piece (52) to move so meanderingly as to cause a horizontally swinging movement of the rearward end of the peripheral bolster part (b), which is required to orient tangentially the irregularly curved edge (b1) in a direction parallel with the rectilinear sewing path presented by the sewing machine (1). Thus, with the movable guide piece (52) being moved via the guide roller (52*a*) along such meandered guide groove (51), the rearward end of the peripheral bolster part (b), which is secured on the movable guide piece (52), is caused to move in a sufficient swinging manner to orient the forward end portion of the irregularly curved edge (b1) in a tangentially identical direction to the rectilinear sewing path, whereupon the curved edge (b1) is precisely juxtaposed and sewn with the rectilinear edge (a1) by the sewing machine (1).

It is noted here that the formation of such guide groove (51) may be varied as desired, depending on a desired shape of the edge (b1). In the shown embodiment, the meandered guide groove (51) assumes such a meandered shape that its sinuosity is gradually reduced from the second extremity (51*b*) to the first one (51*a*) as shown, except that the initial region of the second extremity (51*b*) as well as the terminal region of the first extremity (51*a*) assumes a generally rectilinear line that lies horizontally in parallel with the sewing path.

Designation (6) denotes a support receiving member adapted for receiving and supporting a resulting sewn portion of the two edges (a1)(b1). The support receiving member (6) comprises a pair of spaced-apart elongated arms (6*a*)(6*a*) of a downwardly arced shape, and is disposed adjacent to the sewing machine (1) at the side opposite to the upper stationary guide plate (5), as shown. Between the two arms (6*a*)(6*a*), defined in a clearance (l) into which the sewn portion of the edges (a1)(b1) is entered, to thereby support the jointed central seating and peripheral bolster parts (a1)(b) in an upturned manner, as will be set forth later.

Now, a description will be made as to the operation of the above-described embodiment of the present invention, with reference to FIGS. 10, 11, 12, 13 and 14.

Firstly, the central seating part (a) (which will be referred to as "a central cover blank material" hereinafter) is placed on the recessed area (44) of the lower guide plate (4) and secured thereon by the clamps (43)(43), after which, the peripheral bolster part (b) (which will be referred to as "a peripheral cover blank material", hereinafter) is secured on the upper stationary guide plate (5) in the manner stated above; such as to be secured at the two initial points; namely, the forward end of the peripheral cover blank material (b) is inserted within the support guide member (53) while the rearward end of the same material (b) is secured at the movable guide piece (52) which is positioned at the second extremity (51*b*) of the meandered guide groove (51), as in FIG. 10.

Next, the forward corner portions of the two cover blank materials (a)(b) are juxtaposed with each other and positioned under the pressing member (2*a*) of the sewing machine, as in FIG. 10.

With the edges (a1)(b1) of those blank materials (a)(b) juxtaposed with each other at their respective forward corners and pressingly retained by the pressing retainer (2*a*), the sewing machine (1) is switched on to start its sewing operation. Then, both edges (a1)(b1) are sewn together and fed on by the cooperative action of the needle (2) and pressing retainer (2*a*) of the sewing machine (1). In this regard, the edges (a1)(b1) are fed and sewn forward, preferably along a swing path defined 10 mm inwardly from and in parallel with the edges (a1)(b1) within the sewing margin (m) of 20 mm, as previously mentioned.

Due to such sewing action, the two cover blank materials (a)(b) are pulled in a direction from the right-hand side, where those upper and lower guide plates (5)(4) are initially located, towards the opposite left-hand side, as viewed from FIG. 2, with the result that the lower guide plate (4) and movable guide piece (52) are respectively slidingly moved along the rectilinear guide groove (31) and meandered guide groove (51).

It is to be understood that, as previously stated, those two guide grooves (31) (51) are designed to cause the rectilinear edge (a1) and irregularly curved edge (b1) to be respectively fed in a rectilinearly identical direction and a tangentially identical direction to the rectilinear sewing path wherein they are sewn by the sewing machine (1) and at the same time along the sewing line of 10 mm inwardly from the edges (a1)(b1) in the 20 mm sewing margin (m) of both cover materials (a)(b).

Figure 11:
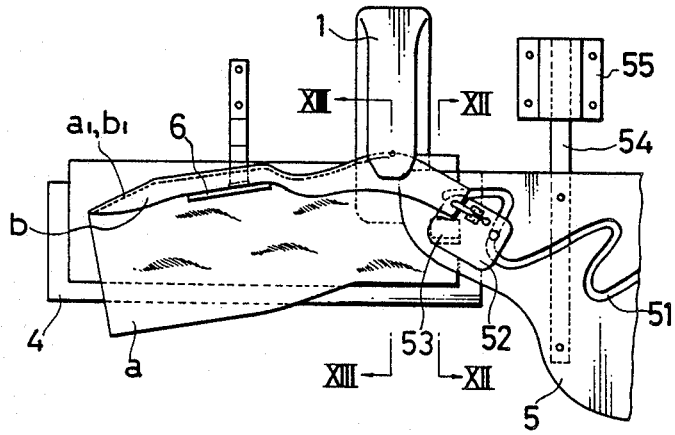
FIG. 11 is a plan view of the sewing apparatus, which shows that the central seating and peripheral bolster parts are being sewn.

Accordingly, during the sewing operation, the irregularly curved shaped edge (b1) of the peripheral cover blank material (b) is being sewn with the rectilinear edge (a1) of the central cover material (a), with a seam being created at 10 mm (in the 20 mm margin (m)) from and along the juxtaposed edges (a1)(b1), as understandable from FIG. 11.

The sewing, therefore, is effected from the forward end to rearward end of the two cover materials (a)(b) along their juxtaposed edges (a1)(b1).

Figure 12:
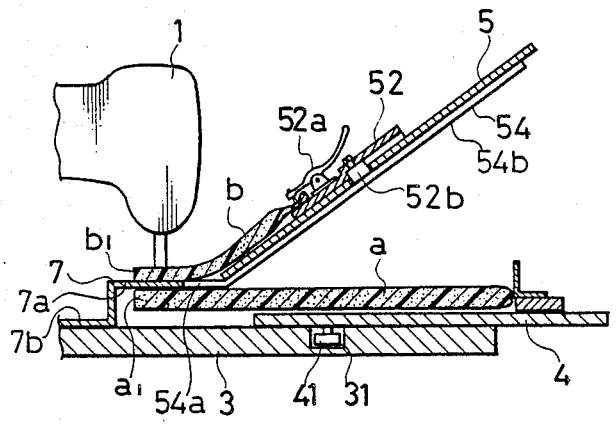
FIG. 12 is a sectional view taken along the line XII—XII in the FIG. 11.
Figure 13:
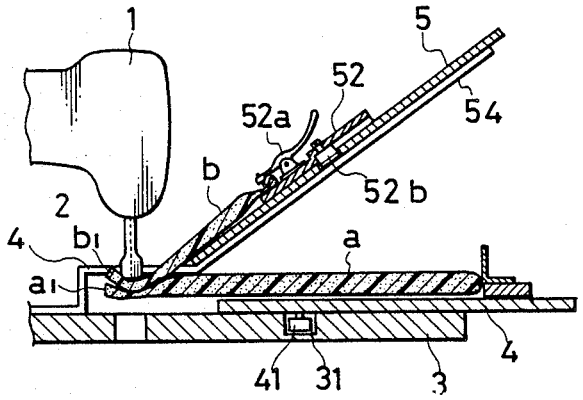
FIG. 13 is a sectional view taken along the line XIII—XIII in the FIG. 11.

In the sewing operation, as seen from FIG. 12, the two edges (b1)(a1), at their non-sewn remainder areas which are to be followed by their sewn areas for sewing, are provisionally separated apart from each other by means of a partition plate member (7) mounted on the table (3). In other words, during the sewing operation, the non-sewn remainder areas of the edges (b1)(a1), shortly before being sewn together, is provisionally kept separated from each other by the partition plate member (7), and thereafter as seen from FIG. 13, such remainder areas of edges (a1)(b1) are fed forth away from the partition plate member (7) to be juxtaposed with each other and subjected to sewing by the needle (2) and pressing retainer member (2*a*) of the sewing machine.

The partition plate member (7) is preferably made of a plastic material having a smooth surface, the arrangement thereof being such that it has a base part (7*b*) fixed on the table (3) and a horizontally extending part (7*a*) which is disposed at a level corresponding to the lower end of the upper stationary guide plate (5), and that the partition plate member (7) per se is situated adjacent to the sewing needle (2) and at the side where the lower guide plate (4) is initially positioned, i.e., at the right-hand side as viewed from FIG. 11. By this partition plate member (7), the edge (b1), at its non-sewn remainder area, is being provisionally kept from the non-sewn remainder area of the edge (a1), just before the two non-sewn areas of edges (a)(b) are fed to the sewing area of the sewing machine (1), whereby the edges (a1)(b1) are prevented against dislocation at the moment of sewing them together.

Thus, after the provisional separation via the partition plate member (7), the edges (a1)(b1) are at once juxtaposed with each other exactly and sewn together by the sewing machine (1), without undesired dislocation between the two edges, so that a precise juxtaposition is attained therebetween, permitting a neat sewing of them together along the uneven or sinuous contour of the edge (b1). This gives a technical solution to the dislocation that will occur in the two different edges when they are directly juxtaposed with each other, prior to sewing.

Figure 14:
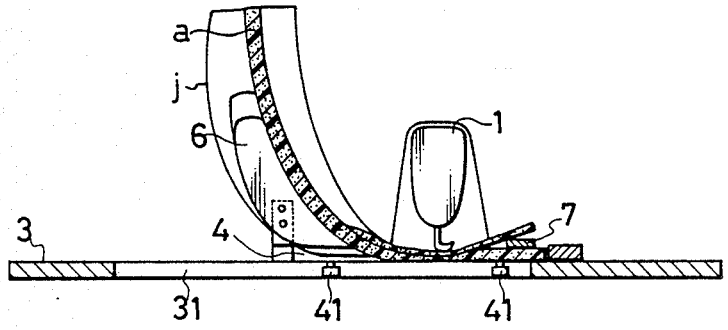
FIG. 14 is a partial front view of the sewing apparatus, showing that the resulting sewn portion is supported upwardly by a support receiving member.
Figure 15:
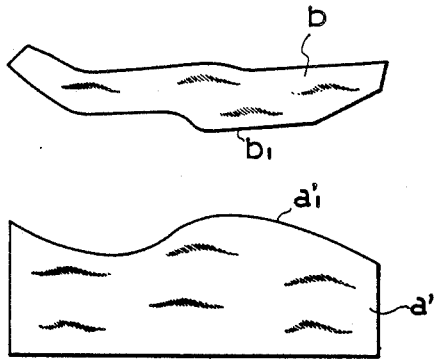
FIG. 15 is a plan view of another central seating and peripheral bolster parts.

While the sewing is being effected as above, it is observed that the unevenly shaped edge (b1) being sewn to the rectilinear one (a1) is naturally turned up as seen in FIG. 11, as a result of which, the two sewn edges (a1)(b1) are opened away from each other relative to their sewn joint portions, thereby representing a generally V-shaped section of thus-jointed central and peripheral cover blank materials (a)(b), in contrast to the non-sewn, juxtaposed state of the edges (a1)(b1). The two cover materials (a) thus jointed are moved towards the support receiving member (6), with the joint corner line (j) thereof defined by the sewn edges (a1)(b1) being slidingly entered into the clearance (l) of the support receiving member (6), as illustrated in FIG. 14. In that way, the sewn area of the two cover materials (a)(b) is slidingly climbed up on the support receiving member, to thereby be placed in a standing state and avoid any undesired twisting or movements of that resulting sewn portion which may adversely affect the precise sewing of the non-sewn edges (a1)(b1).

When the sewing proceeds close to the terminal point, i.e., at both rearward end areas of the edges (a1)(b1), as shown in FIG. 11, the sewn portion of the two cover materials (a)(b) is supported upright by the support receiving member (6), and the movable guide piece (52) with the rearward end (b1) thereon is entered into the support guide member (53), whereby the movable guide piece (52) is retained within the support guide member (53) against falling out of the upper stationary guide plate (5). In this respect, such retaining function of the support guide member (53) is essential in view of the fact that, at the area adjacent the support guide member (53), the peripheral blank material (b) is urged to twist upwardly due to the above-described sewing, attempting to throw out from the upper guide plate (5) the movable guide piece (52) approaching to that area. At the completion of sewing operation, the resulting sewn product is then left upon the support receiving member (6), whereupon one side of the trim cover assembly (A) is finished. The other side of the same (A) is to be finished in the same way as described above. As for the lateral wall part (c), an operator then has to replace the upper and lower guide plates (5)(4) by other different suitable ones and operate the sewing apparatus in the same way as above.

Reference is made to FIG. 15, 16, 17, 18, 19 and 20, wherein illustrative is another embodiment of the present invention which permits sewing together the above-stated peripheral cover blank material (b) having the unevenly shaped edge (b1) and another central cover blank material (a') having such a convex-concave wavy edge (a'1) which is shown as being of "~" shape, in contrast to the rectilinear edge (a1) of the above-mentioned central cover material (a). It should be understood that the central cover blank material (a') refers to a central seating part of trim cover assembly, like the foregoing central cover blank material (a) in the above first embodiment.

In the present embodiment, all elements and mechanisms thereof are identical to those of the above-described first embodiment, except that another lower guide plate (4') and table (3') are employed. All like designations in the first embodiment refers to all like ones in this particular second one, and thus a specific description is omitted thereon.

Figure 16:
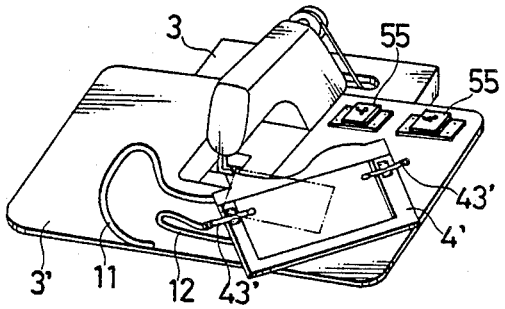
FIG. 16 is a perspective view of another embodiment of the present invention.

As shown on FIG. 16, the sewing apparatus has the table (3') fixed thereon, upon which table (3') there is provided the securing members (55)(55) for detachably securing the aforementioned upper stationary guide plate (5).

The lower guide plate (4') and upper stationary guide plate (5) are respectively adapted for securing the central cover blank material (a') and peripheral cover blank material (b) thereon. For that purpose, on the former guide plate (4'), a pair of clamps (43') (43') are provided as shown.

Figure 17:
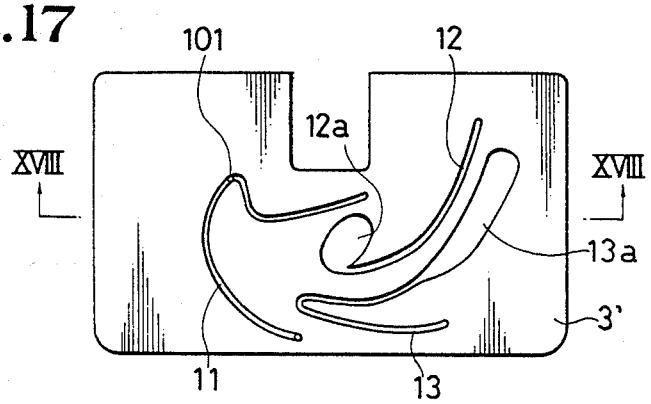
FIG. 17 is a table of the sewing apparatus in the same embodiment as in the FIG. 16.
Figure 18:
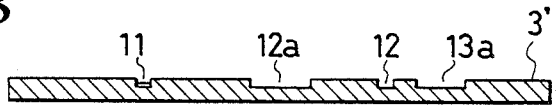
FIG. 18 is a sectional view taken along the line XVIII—XVIII in the FIG. 17.

Referring to FIGS. 17 and 18, the table (3') is formed with three different meandered guide grooves (11)(12)(13) on its upper surface.

Figure 19:
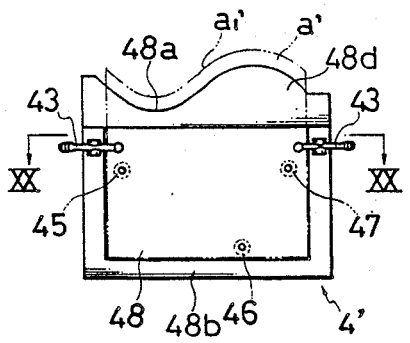
FIG. 19 is a plan view of a lower guide plate of another embodiment as in FIG. 16.
Figure 20:
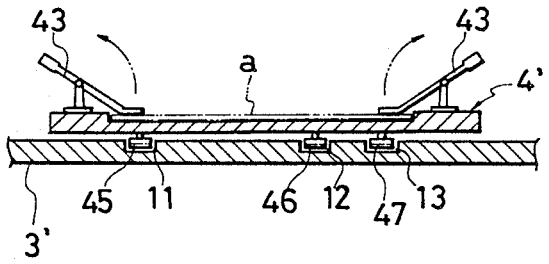
FIG. 20 is a sectional view taken along the line XX—XX in the FIG. 19.

Referring to FIGS. 19 and 20, the lower guide plate (4') is so constructed that a recessed area (48) is defined therein for receipt of the central cover blank material (a'), with a "U'-shaped rim (48*b*) defined around the recessed area (48), thus forming an opened side (48*d*) at one end, and a wavy edge portion (48*a*) is provided at the opened end (48*d*), the wavy edge portion (48*a*) corresponding in shape to the edge (a'1) of the central cover blank material (a'). Preferably, the wavy edge portion (48*a*) is made of a stainless steel plate, or the like. Further, the lower guide plate (4') has, provided at its reverse side, three guide rollers (45)(46)(47) in a rotatable manner, which are arranged in a spaced-apart relation with one another as shown, and slidably fitted in the three meandered guide grooves (11)(12)(13), respectively. The disposition of those three guide rollers (45) (46)(47) is, in brief, such that they form three vertex points of a triangle, with the first one (45) located on the left-hand side, the second one (56) located on the side adjacent to the horizontal rim section of the rim (48*b*), and the third one (47) located on the right-hand side, as viewed from FIG. 19.

The formation of the three meandered guide grooves (11)(12)(13) is determined in conformity with the respective tracks or traces to be shown by the three guide rollers (45)(46)(47) in order for the lower guide plate (4') to move in an adequate direction wherein the wavy edge (a'1) of the central cover blank material (a') secured on the lower guide plate (4') is sewn with the uneven edge (b1) of the peripheral cover blank material (b). Further, the second guide groove (12) is formed with a circular widened groove (12*a*) and also the third guide groove (12) is formed with an elongated widened groove (13*a*), as shown in FIG. 17. Those two widened grooves (12*a*)(13*a*) are intended to let idle and move freely therein the second and third guide rollers (46)(47), respectively, so as not to cause a mutual obstruction of the three guide rollers (45)(46)(47) against their respective movements along the guide grooves (11)(12)(13), and further those widened grooves (12*a*)(-13*a*) are designed to establish a coactive movement of at least two of the guide rollers (45)(56)(47) for stably guiding the lower guide plate (4'). In this respect, the arrangement of the two widened grooves (12*a*)(13*a*) as well as the three guide grooves (11)(12)(13) may be determined in any desired patterns, inasmuch as they are effective under such condition. In the shown embodiment, to state briefly, the circular widened groove (12*a*) us great in area relative to the outer diameter of the guide roller (46), which is effective in setting idly or moving freely that guide roller (46) in order to allow the first and third guide rollers (45)(47) to coactively pass through acutely or U-turn curved sections of their corresponding guide grooves (11)(13). The elongated widened groove (13*a*) is effective in avoiding the obstruction of the third guide roller (47) against the first and second guide rollers (45)(46) which start to be moved along the initial sections of their corresponding guide grooves (11)(12), which initial sections are greatly distant from each other.

Accordingly, in this second embodiment, although not specifically shown, it is seen that, when the sewing machine (1) is actuated, both differently curved edges (a'1) (b1) respectively of the central and peripheral cover material (a)(b) are fed towards the sewing needle (1) in a direction tangentially identical to a sewing direction wherein those edges (a'1)(b1) are fed and sewn by the sewing machine (1), by virtue of their respective guide grooves and rollers (11, 12, 13, 45, 46, 47, 51, 52*b*), whereby the sewing is effected along the two differently curved edges (a'1)(b1), with a seam being left in parallel therewith and thus, despite the different uneven curvature, the edges (a'1)(b1) are fed and juxtaposed neatly with each other for sewing together in an unattended, automatical manner.

From the above description, it is appreciated that, in accordance with the present invention, the following advantages are found:

(1) An automatical operation is effected for sewing together two differently uneven or curved edges of blank materials. A rapid sewing process with good work efficiency is attained, contributing to the far-going improvement in producing a number of sewn products.

(2) Any different upper and lower guide plates with different guide grooves may be attached to the table of the sewing apparatus, depending on a desired kind of work to be sewn, thus providing a flexible choice in this regard.

While having as above described, the present invention is not limited to the illustrated embodiments, and any other modifications, replacements and additions may structurally be possible without departing from the scope and spirit of the appended claims for the invention.

What is claimed is:

1. An automatic sewing apparatus, which is adapted for sewing a curved edge of a first blank material with an edge of a second blank material, comprising:
   - a sewing means;
   - a table of said sewing means;
   - a lower guide plate which is movably mounted on said table, upon which lower guide plate, secured is said second blank material;
   - an upper guide plate which is fixedly supported in such as manner as to be disposed above said lower guide plate, upon which upper guide plate, secured is said first blank material; and
   - said upper guide plate being formed with a guide groove and having a movable guide piece movable along said guide groove, said movable guide piece being adapted to secure thereon a rearward end of said first blank material and further having a slidable means which is slidably fitted in said guide groove, wherein said guide groove is formed in a shape conforming to a track which is to be shown by said slidable means in order to orient said curved edge of said first blank material in a tangentially identical direction to a sewing path of said sewing means.

2. The automatic sewing apparatus according to claim 1, wherein said lower guide plate is slidable along a groove formed on an upper surface of said table.

3. The automatic sewing apparatus according to claim 2, wherein said groove is formed in a rectilinear shape, and said lower guide plate has a pair of guide rollers rotatably provided therein, said pair of guide rollers being slidably fitted in said groove.

4. The automatic sewing apparatus according to claim 1, wherein said edge of said second blank material is formed in a sinuously wavy shape, wherein said lower guide plate has three guide rollers rotatably provided at its reverse side, wherein upon said table there are formed three guide grooves in which said three guide rollers are respectively slidably fitted, and wherein said three guide grooves are formed in shapes conforming to respective tracks which are to be shown by said three guide rollers in order to permit sewing said sinuously wavy edge of said second blank material with said curved edge of a first blank material.

5. The automatic sewing apparatus according to claim 1, wherein said upper guide plate is supported by a support arm provided on said table in such a manner as to be inclined upwardly at 30 to 45 degrees in relation to said table.

6. The automatic sewing apparatus according to claim 1, wherein there is provided a partition plate member on said table, said partition plate member being made of a synthetic resin material and adapted for separating said curved edge of said first blank material from said edge of said blank material, shortly before said two edges are sewn by said sewing means, thereby preventing a contact between them prior to being sewn together in order to avoid an incorrect juxtaposition thereof.

7. The automatic sewing apparatus according to claim 1, wherein said movable guide piece on said upper guide plate is provided with a clamp for securing one end of said first blank material.

8. The automatic sewing apparatus according to claim 1, wherein, upon said upper guide plate, there is integrally provided a means for preventing said movable guide piece from being fallen off from said upper guide plate, such that said means is disposed at one extremity of said guide groove in vicinity of said sewing means.

9. The automatic sewing apparatus of claim 1, wherein, upon said upper guide plate, there is provided a means for turning up and retaining in an upright state a resulting sewn unit of said first and second blank materials, such that said means is disposed adjacent to an area of said upper guide plate where said resulting sewn unit is transferred from said sewing means.

10. The automatic sewing apparatus according to claim 1, wherein said edge of said second blank material is of a rectilinear shape and said curved edge of said first blank material is of an irregularly curved shape.

11. The automatic sewing apparatus according to claim 1, wherein said edge of said second blank material is of a curved shape.

12. The automatic sewing apparatus according to claim 1, wherein said first and second blank materials are both of a three-layer lamination which comprises a top surface layer, a foam wadding layer and a wadding back layer.

13. The automatic sewing apparatus according to claim 1, wherein said slidable means comprises a guide roller which is rotatable provided at the reverse side of said movable guide piece.

* * * * *